US005129341A

United States Patent [19]

Wang

[11] Patent Number: 5,129,341

[45] Date of Patent: Jul. 14, 1992

[54] RETAINING DEVICE FOR A COVER OF A SEWING MACHINE

[76] Inventor: Shui-Nu Wang, No. 6, Nan Pin Road, Taichung, Taiwan

[21] Appl. No.: 676,309

[22] Filed: Mar. 28, 1991

[51] Int. Cl.[5] ..... D05B 75/06; E05C 3/14

[52] U.S. Cl. ..... 112/260; 292/228

[58] Field of Search ..... 112/258, 259, 260; 292/121, 128, 219, 228, 102, DIG. 11; 312/208

[56] References Cited

U.S. PATENT DOCUMENTS

| | | | |
|---|---|---|---|
| 363,655 | 5/1887 | Littlejohn | 112/260 |
| 2,197,195 | 4/1940 | Schemers | 292/DIG. 31 X |
| 2,394,395 | 2/1946 | Morand | 292/128 |
| 2,634,997 | 4/1953 | Gallowitz | 292/128 |
| 2,945,461 | 7/1960 | Perla | 112/260 |
| 4,057,272 | 11/1977 | Vahle et al. | 292/128 |
| 5,066,055 | 11/1991 | Saitoh et al. | 292/228 |

FOREIGN PATENT DOCUMENTS

| | | | |
|---|---|---|---|
| 7604269 | 4/1976 | Netherlands | 112/260 |
| 271628 | 11/1950 | Switzerland | 112/260 |

*Primary Examiner*—Werner H. Schroeder
*Assistant Examiner*—Paul C. Lewis

[57] ABSTRACT

A retaining device for coupling a cover to a sewing machine. A stop is fixed in the base. A lever has a middle portion pivotally supported on a support which is fixed on a bottom of the cover. A handle is formed on one end of the lever and is reachable from outside of the cover. A pawl is formed on the other end of the lever. A spring is provided to bias the pawl to engage with the stop so that the cover can be retained in a closed position. When the handle is pulled upward, the pawl can be separated from the stop so that the cover can be opened.

6 Claims, 3 Drawing Sheets

RETAINING DEVICE FOR A COVER OF A SEWING MACHINE

BACKGROUND OF THE INVENTION (a) Field of the Invention

The present invention relates to a retaining device, and more particularly to a retaining device for a cover of a sewing machine.

(b) Description of the Prior Art

A sewing machine generally comprises a cantilever beam disposed on a base and a needle extending downward from the free end portion of the cantilever beam for conducting sewing operations. A working surface is formed on the upper surface of the base, in which a board is formed therein. The board is located under the needle and is openable so that a roll of thread can be inserted into the base. However, the size of the board is small so that the insertion of the roll of thread is difficult.

The present invention has arisen to mitigate and/or obviate the afore-described disadvantages of the conventional sewing machines.

SUMMARY OF THE INVENTION

The primary objective of the present invention is to provide a retaining device which can stably retain the cover of the sewing machine in place and which is arranged such that the cover can be easily opened so that the parts and elements disposed in the base can be easily reached.

In accordance with one aspect of the present invention, there is provided a retaining device for coupling a cover to a base of a sewing machine. A stop is fixed in the base of the sewing machine. A support is fixed on a bottom of the cover. A lever has a middle portion pivotally supported on the support by a pin. A handle portion which is formed on one end of the lever extends outward of the cover and is reachable from outside of the cover. A pawl is formed on the other end of the lever. A spring is engaged on the pin for biasing the pawl upward to engage with the stop of the base so that the cover can be retained in a closed position. When the handle portion is caused to rotate against the spring, the pawl can be caused to be separated from the stop so that the cover can be opened.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
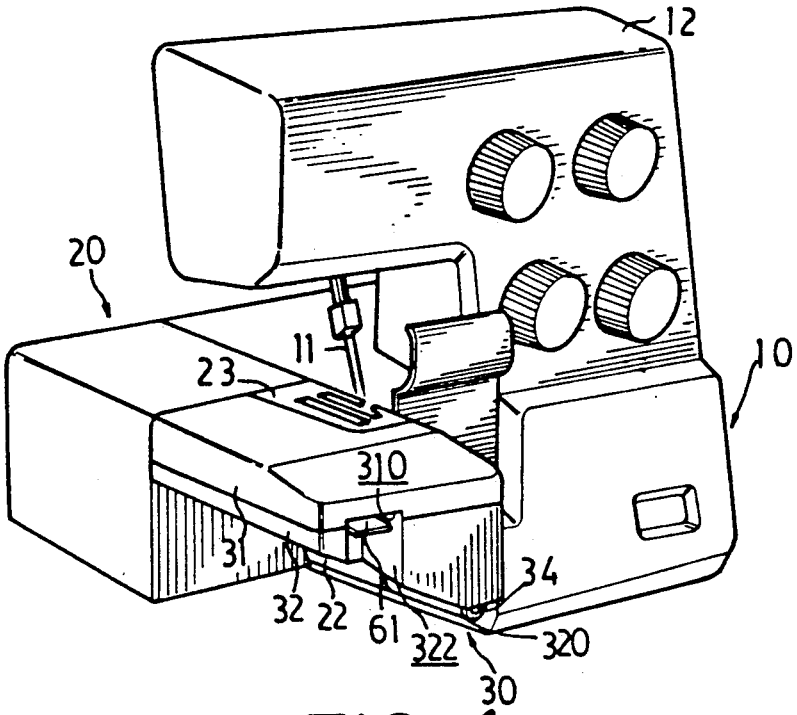
FIG. 1 is a perspective view of a sewing machine in which a retaining device in accordance with the present invention is disposed therein.
Figure 2:
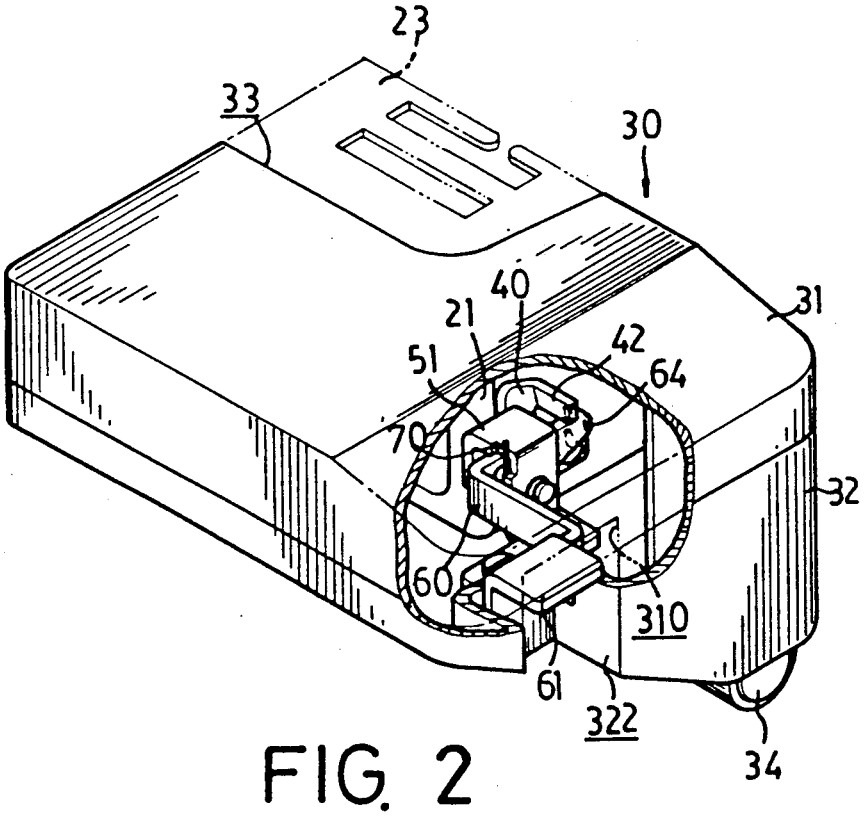
FIG. 2 is a partial perspective view of the retaining device in which part of the cover is cut off.
Figure 3:
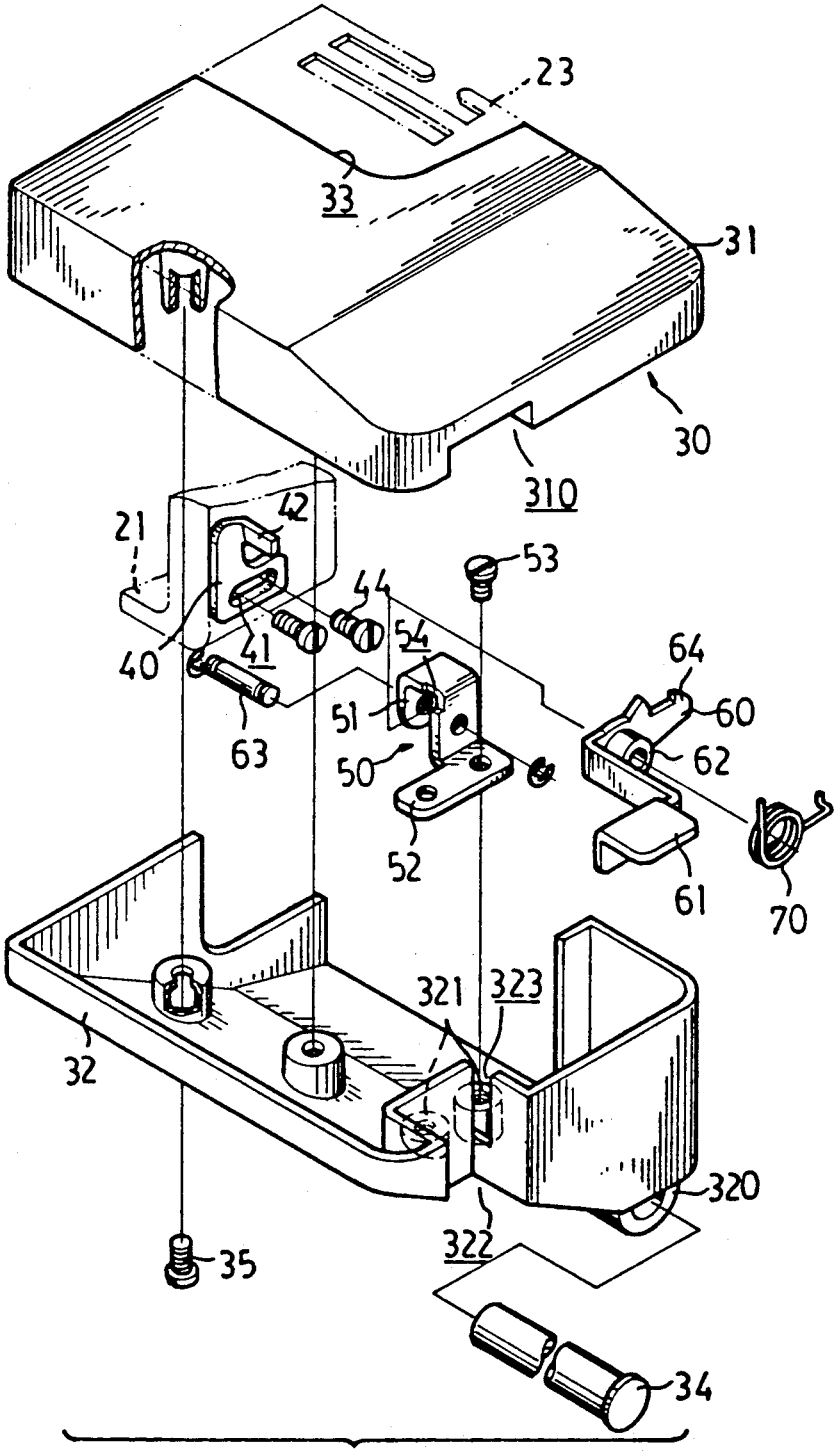
FIG. 3 is an exploded view of the retaining device.

Referring to the drawings and initially to FIGS. 1, 2 and 3, a sewing machine generally comprises a cantilever beam 12 disposed on a base 10 thereof and a needle 11 extending downward from the free end portion of the cantilever beam 12 for conducting sewing operations. A housing 20 and a cover 30 are provided for covering the feeding mechanism disposed within the base 10. A board 23 is integrally fixed to the base 10 of the sewing machine and is located below the needle 11. Some parts, such as a roll of thread, are disposed in the base 10 and located beneath the board 23. The needle 11 is extendible through a slot formed in the board 23 and is engageable with the roll of thread in order to conduct the sewing operations. The retaining device in accordance with the present invention is provided for retaining the cover 30 in place and is arranged such that the cover 30 can be easily opened, in order that the parts and mechanism disposed in the base 10 are reachable and exchangeable.

The cover 30 includes an upper casing 31 and a lower casing 32 coupled together by such as bolts 35. An opening 33 is formed in a corner area of the upper casing 31. The board 23 fits in the opening 33 when the upper casing 31 is retained in a working position, and is flush with the upper surface of the upper casing 31 so that a working surface is formed by the upper casing 31 and the board 23. Clothes to be sewed can be disposed upon the working surface. Preferably, a recess 310 is formed in one side of the bottom of the upper casing 31.

A cylindrical portion 320 is formed on the bottom of the lower casing 32 and is pivotally coupled to a cylindrical portion 22 (FIG. 1) of the base 10 by a pivot axle 34 so that the cover 30 is rotatable about the pivot axle 34. Two protrusions 321 are formed on the bottom of the lower casing 32. A recess 322 is formed in one side of the lower casing 32 and is aligned with the recess 310 of the upper casing 31 when the two casings 31, 32 are coupled together. A gap 323 is formed in the lower casing 32 and communicates the recess 322 to the interior of the lower casing 32.

A support 40 has an oblong hole 41 formed in the lower portion thereof and is fixed to a partition plate 21 by such as two bolts 44. The partition plate 21 is fixed in the base 10 of the sewing machine. A stop 42 extended from the upper portion of the support 40 is substantially perpendicular to the support 40. A bracket 50 has an inverted U-shaped portion 51 formed above a seat 52. The seat 52 is fixed to the protrusions 321 by such as bolts 53. A notch 54 is formed on one side of the U-shaped portion 51.

A cylinder 62 is formed in the middle portion of a lever 60 and is pivotally supported between two leg portions of the U-shaped portion 51 by a pin 63 so that the lever 60 is rotatable about the pin 63. The lever 60 is substantially N-shaped having a handle portion 61 formed on a first end and having a pawl 64 formed on a second end thereof. A spring 70 which is engaged on the cylinder 62 has a first end engaged in the notch 54 of the U-shaped portion 51 and has a second end engaged on the lower portion of the pawl 64 so that the pawl 64 can be biased upward. The notch 54 limits the movement of the first end of the spring 70. The first end portion of the lever 60 extends through the gap 323 of the lower casing 30 so that the handle portion 61 is located in the recess 322 of the lower casing 30 and is reachable from outside of the lower casing 30.

Figure 4:
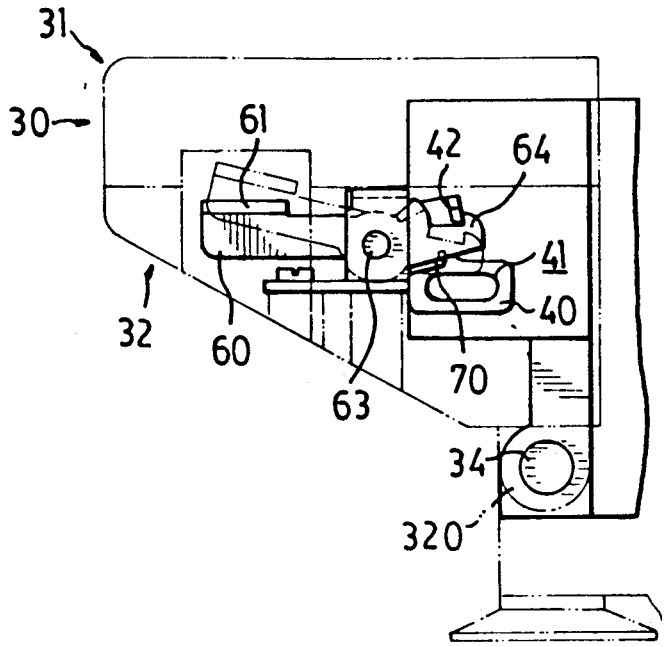
FIGS. 4 and 5 are plane views illustrating the movement of the retaining device.
Figure 5:
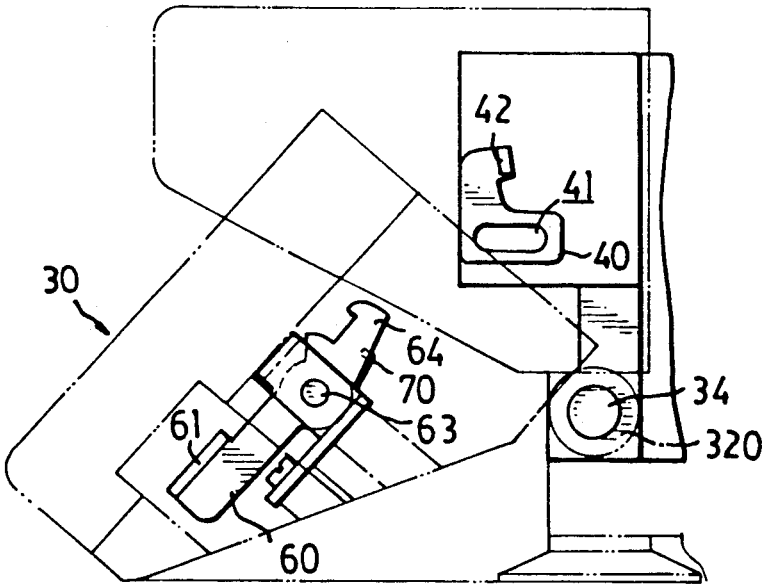

In operation, as shown in FIGS. 4 and 5, the pawl 64 is biased upward by the spring 70 to engage with the stop 40 of the support 40 so that the cover 30 can be retained in a closed position as shown in FIG. 4. When the handle portion 61 is pulled upward by a user, the pawl 64 is caused to move downward against the resilience of the spring 70 so that the pawl 64 can be disengaged from the stop 40 and so that the cover 30 can be rotated about the pivot axle 34 to the open position.

Accordingly, the retaining device in accordance with the present invention can stably secure the cover of the sewing machine in place. The cover can be easily opened when the handle portion 61 is pulled upward.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retaining device comprising a cover having a lower portion pivotally coupled to a base of a sewing machine, a stop fixed in said base of said sewing machine, a bracket fixed on a bottom of said cover and including a seat fixed on said bottom of said cover and a U-shaped portion formed above said seat, said U-shaped portion including a pair of legs, a lever having a middle portion pivotally supported between said legs of said bracket by a pin so that said lever is rotatable about said pin, a handle portion formed on a first end of said lever, said handle portion extending outward of said cover and reachable from outside of said cover, a pawl being formed on a second end of said lever, and a spring engaged on said pin for biasing said pawl, said spring having a first end engaged on said U-shaped portion and having a second end engaged on said pawl so that said pawl is biased by said spring, a notch formed in one side of said U-shaped portion, said first end of said spring being engaged in said notch so that movement of said first end of said spring can be limited, said pawl being biased by said spring to engage with said stop of said base so that said cover can be retained in a closed position, and when said handle portion is moved, said lever is rotated against said spring, and said pawl is separated from said stop so that said cover can be opened.

2. A retaining device comprising a cover having a lower portion pivotally coupled to a base of a sewing machine, a stop fixed in said base of said sewing machine, a bracket fixed on a bottom of said cover and including a seat fixed on said bottom of said cover and a U-shaped portion formed above said seat, said U-shaped portion including a pair of legs, a lever having a middle portion pivotally supported between said legs of said bracket by a pin, a cylinder formed on said middle portion of said lever and rotatably supported on said pin so that said lever is rotatable about said pin, a handle portion formed on a first end of said lever, said handle portion extending outward of said cover and reachable from outside of said cover, a pawl being formed on a second end of said lever, and a spring engaged on said pin for biasing said pawl, said spring having a first end engaged on said U-shaped portion and having a second end engaged on said pawl so that said pawl is biased by said spring, said pawl being biased by said spring to engage with said stop of said base so that said cover can be retained in a closed position, and when said handle portion is moved, said lever is rotated against said spring, and said pawl is separated from said stop so that said cover can be opened.

3. A retaining device comprising a cover having a lower portion pivotally coupled to a base of a sewing machine, a stop fixed in said base of said sewing machine, a bracket fixed on a bottom of said cover and including a seat fixed on said bottom of said cover and a U-shaped portion formed above said seat, a pair of protrusions formed on said bottom of said cover, said seat of said bracket being fixed on said protrusions, said U-shaped portion including a pair of legs, a lever having a middle portion pivotally supported between said legs of said bracket by a pin so that said lever is rotatable about said pin, a handle portion formed on a first end of said lever, said handle portion extending outward of said cover and reachable from outside of said cover, a pawl being formed on a second end of said lever, and a spring engaged on said pin for biasing said pawl, said spring having a first end engaged on said U-shaped portion and having a second end engaged on said pawl so that said pawl is biased by said spring, said pawl being biased by said spring to engage with said stop of said base so that said cover can be retained in a closed position, and when said handle portion is moved, said lever is rotated against said spring, and said pawl is separated from said stop so that said cover can be opened.

4. A retaining device comprising a cover having a lower portion pivotally coupled to a base of a sewing machine, a stop fixed in said base of said sewing machine, a bracket fixed on a bottom of said cover, a lever having a middle portion pivotally supported on said bracket by a pin, a handle portion being formed on a first end of said lever, said cover including an upper casing and a lower casing connectable with each other, a recess formed in one side of said lower casing, a gap formed in said lower casing and communicating said recess to an interior of said lower casing, said first end of said lever extending through said gap so that said handle portion substantially extends in said recess of said lower casing and so that said handle portion is reachable from outside of said cover, a pawl being formed on a second end of said lever, and a spring engaged on said pin for biasing said pawl, said pawl being biased by said spring to engage with said stop of said base so that said cover can be retained in a closed position, and when said handle portion is caused to rotate against said spring, said pawl can be caused to be separated from said stop so that said cover can be opened.

5. A retaining device according to claim 4, wherein a board is fixed to said base, an opening is formed in one corner area of said upper casing, said board fits in said opening of said upper casing and is flush with an upper surface of said upper casing so that a working surface is formed by said board and said upper casing, said board is located below a needle of said sewing machine.

6. A retaining device according to claim 4, wherein a second recess is formed in a lower portion of said upper casing and is aligned with said recess of said lower casing when said upper casing and said lower casing are coupled together so that said handle portion can be easily operated.

* * * * *